US007241043B1

(12) United States Patent
Wu

(10) Patent No.: US 7,241,043 B1
(45) Date of Patent: Jul. 10, 2007

(54) DECORATION TREE WITH INSERTED ARTICLES

(76) Inventor: Jiahn-Chang Wu, No. 15, Lane 13, Alley 439, Her-Chiang Street, Chutung, Hsin-Chu, Taiwan (CN) 310

( * ) Notice: Subject to any disclaimer, the term of this patent is extended or adjusted under 35 U.S.C. 154(b) by 0 days.

(21) Appl. No.: 11/425,829

(22) Filed: Jun. 22, 2006

(30) Foreign Application Priority Data

Jan. 2, 2006 (TW) ..... 95100003 A

(51) Int. Cl.
*F21W 121/04* (2006.01)

(52) U.S. Cl. ..... 362/659; 362/123; 362/654; 362/658; 428/19; 439/924.1

(58) Field of Classification Search ..... 362/652, 362/653, 654, 655, 656, 657, 658, 659, 122, 362/123, 568; 439/668, 924.1; 428/18–20
See application file for complete search history.

(56) References Cited

U.S. PATENT DOCUMENTS 4,156,892 A * 5/1979 Fisher ..... 362/123
4,920,467 A * 4/1990 Honsberger ..... 362/658
5,010,463 A * 4/1991 Ross ..... 362/253

* cited by examiner

*Primary Examiner*—Laura Tso

(57) ABSTRACT

The trunks and/or branches of a decoration tree are made of "metal mesh/insulation/metal mesh" sandwiched structure. Ornamental articles are configured to be easily and rapidly inserted into the sandwiched structure to decorate the decoration tree. The two metal meshes are each coupled to one of the two electrodes of an electric power supply. The coaxial pin of each ornamental article is made coaxial to couple to the two metal meshes respectively, so that the ornamental article shines when it has been inserted in the trunks or branches of the tree.

6 Claims, 6 Drawing Sheets

DECORATION TREE WITH INSERTED ARTICLES

RELATED APPLICATIONS

The present application is based on, and claims priority from, Taiwan Application Number 095100003, filed Jan. 2, 2006, the disclosure of which is hereby incorporated by reference herein in its entirety.

FIELD OF THE INVENTION

The present invention is related to a decoration tree that can be used as an ornamental tree in a family, office, factory, garden . . . etc.

DESCRIPTION OF THE RELATED ART

FIG. 1 is a prior art decoration tree.

A conventional decoration tree 10 shown in FIG. 1 has artificial leaves 11, ornamental lamps 13 that are electrically coupled to a string of electric wire 12, wherein the electric wire 12 winds around the tree leaves 11. The trunk 18 is fixed in a pedestal 19 to support the trunk, branches, and leaves.

SUMMARY OF THE INVENTION

The present invention uses "metal/insulation/metal" sandwiched structure as the material of the trunk and/or branches of a decoration tree. Inserted articles are configured to have an insertion lead to be inserted into the branches or the trunk of the decoration tree. The inserted articles can be easily plugged and unplugged, so that it is convenient and rapid to change or replace different ornamental articles. The ornamental articles includes embedded lighting devices, and shine when they are inserted in position.

DETAILED DESCRIPTION OF THE PREFERRED EMBODIMENTS

Figure 1:
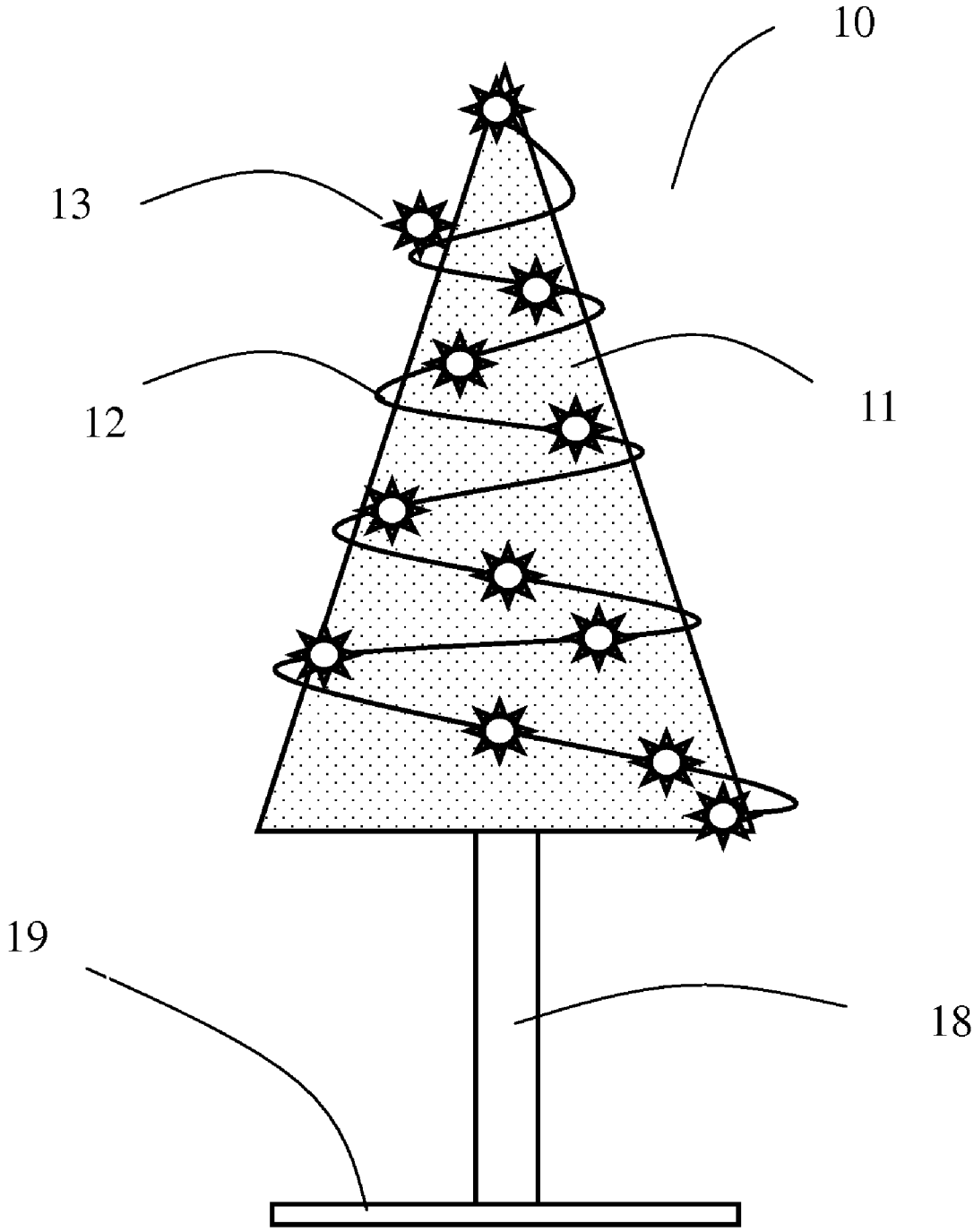
Fig. 1. Prior Art.
FIG. 1. shows a conventional device.
Figure 2:
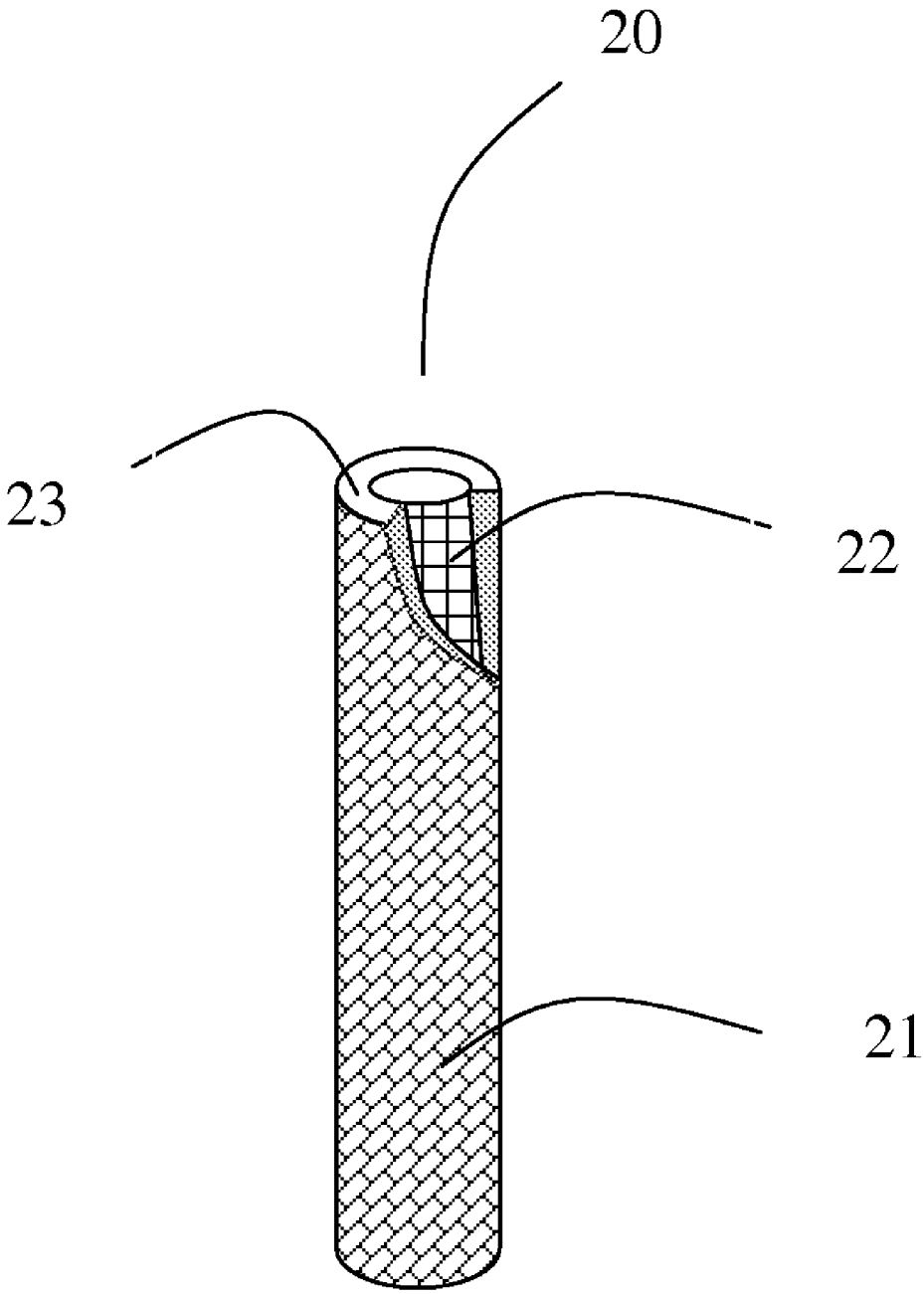
FIG. 2. shows a sandwiched structure used for the trunk or branches of the present invention.

FIG. 2. shows a sandwiched structure used for the trunk or branches of the present invention. FIG. 2 shows a sandwiched structure 20 of "first metal mesh 21/insulation layer 23/second metal mesh 22" to be used as the material for the trunk or the branches of a decoration tree in the present invention. The first metal mesh 22 and the second metal mesh 23 are respectively coupled to the two terminals of a power supply (not shown in the figure). The insulation in the present invention can be foam, sponge, plastic, rubber, or styrofoam, etc. The structure can be hollow or tube-like as shown, or its center can be filled with appropriate insulating material.

Figure 3:
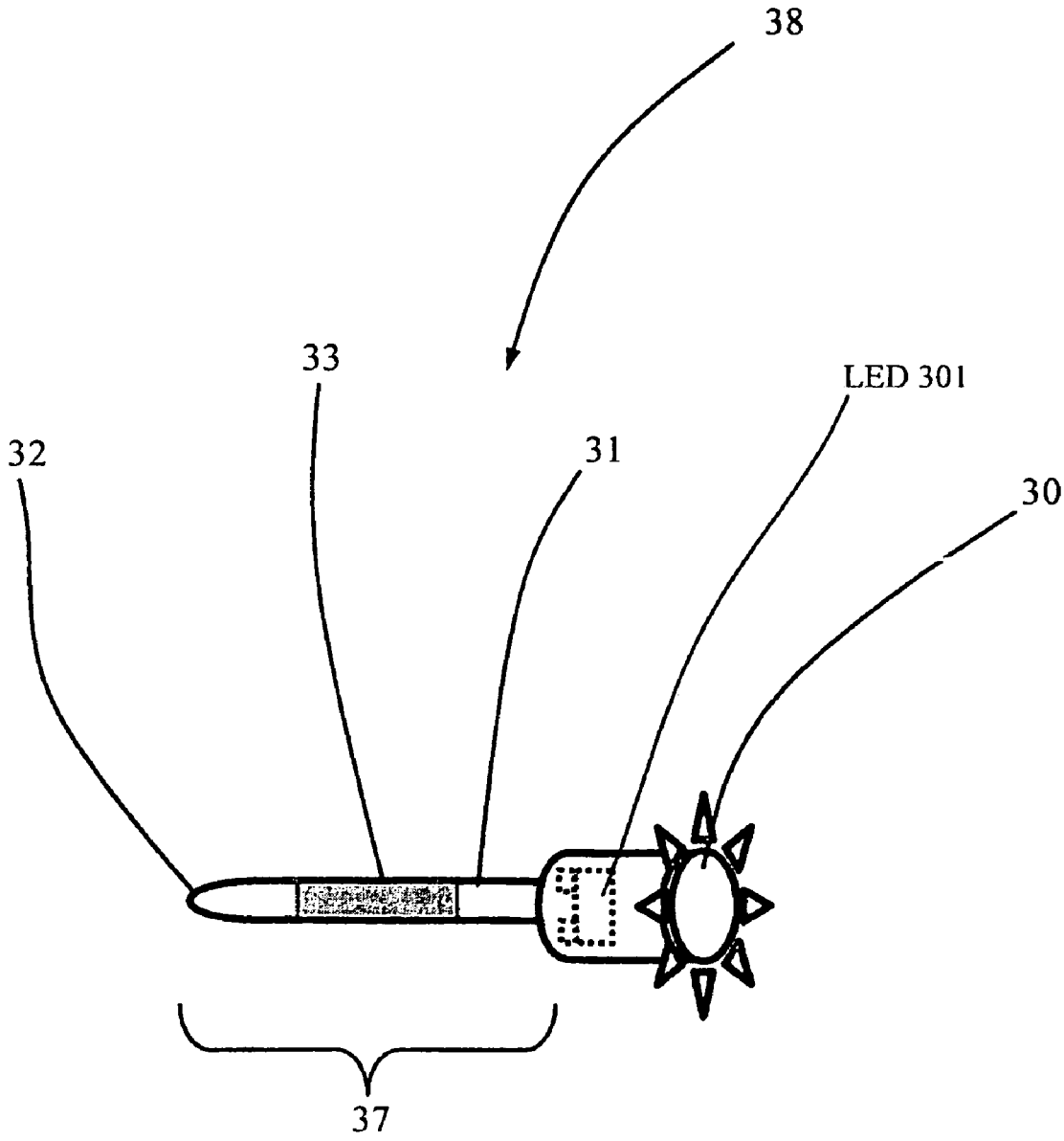
FIG. 3. shows a first embodiment of an ornamental article used in the present invention.

FIG. 3. shows a first embodiment of an ornamental article used in the present invention. An ornamental such as star 30 is illustrated as a head of an ornamental article 38. The ornamental article 38 has a stem 37 that has a first electrode 31 and a second electrode 32 respectively electrically coupling to the two electrodes of a light emitting chip (see LED 301 schematically depicted in broken line in FIG. 3) embedded in the ornamental article 38. An insulation layer 33 is inserted in between the first electrode 31 and the second electrode 32, the first electrode 31 and the second electrode 32 are arranged coaxial similar to the coaxial electric plug of an earphone. When the ornamental article 38 is inserted through the meshes of the sandwiched structure of the trunk or branches in position, the first metal electrode 31 shall couple to the first metal mesh 21, and the second metal electrode 32 shall couple to the second metal mesh 22, and the ornamental article 38 shall emit light when the power is turned on.

Figure 4:
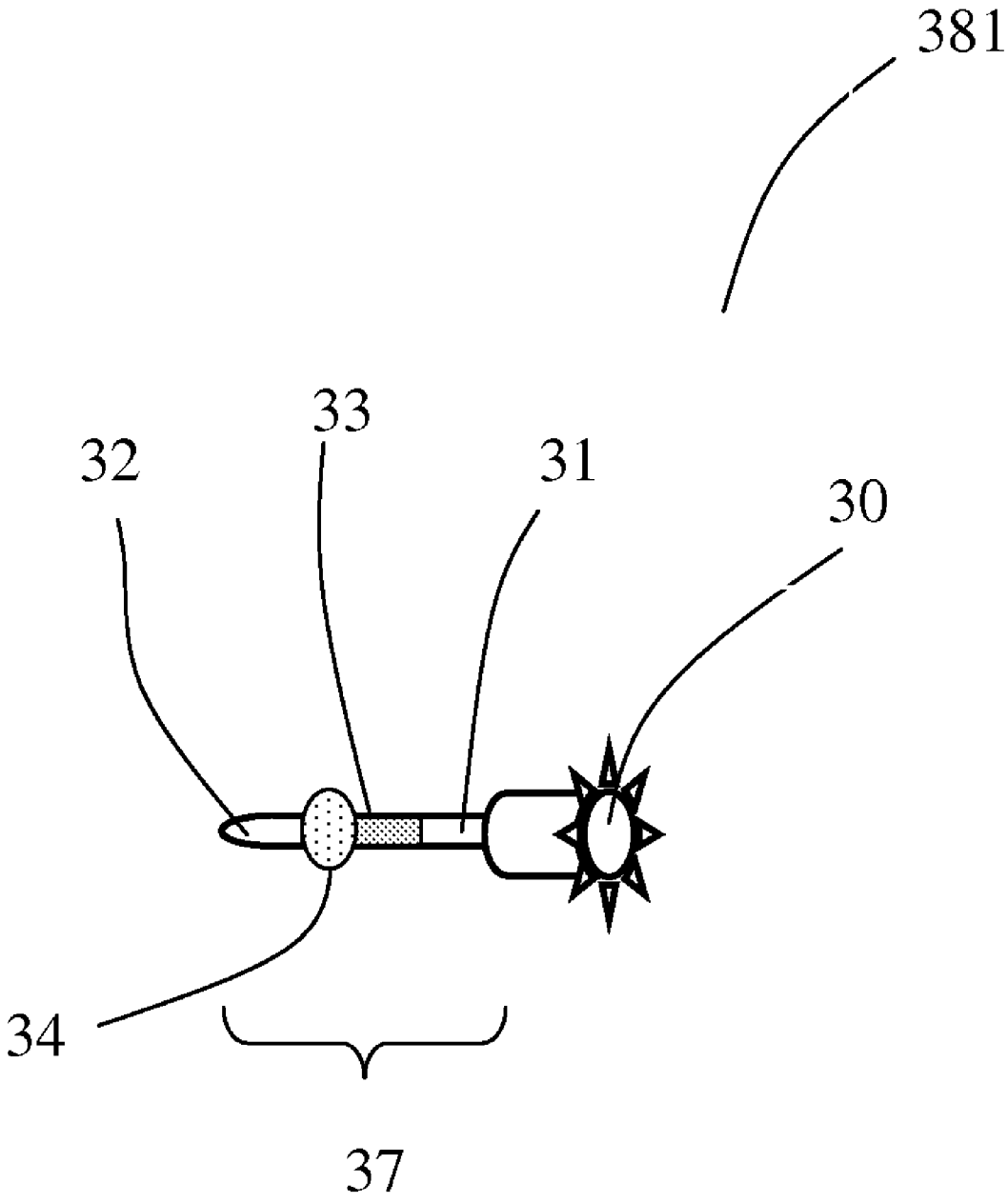
FIG. 4. shows a second embodiment of an ornamental article used in the present invention.

FIG. 4. shows a second embodiment of an ornamental article used in the present invention, which is similar to the one in FIG. 3, except for an additional bump 34 between the first electrode 31 and the second electrode 32. The bump 34 shall stay between the first metal mesh 21 and the second metal mesh 22 of a trunk or branches 20 for steadily holding the ornamental article 381 in position without falling off the branches or trunk 20 of the decoration tree.

Figure 5:
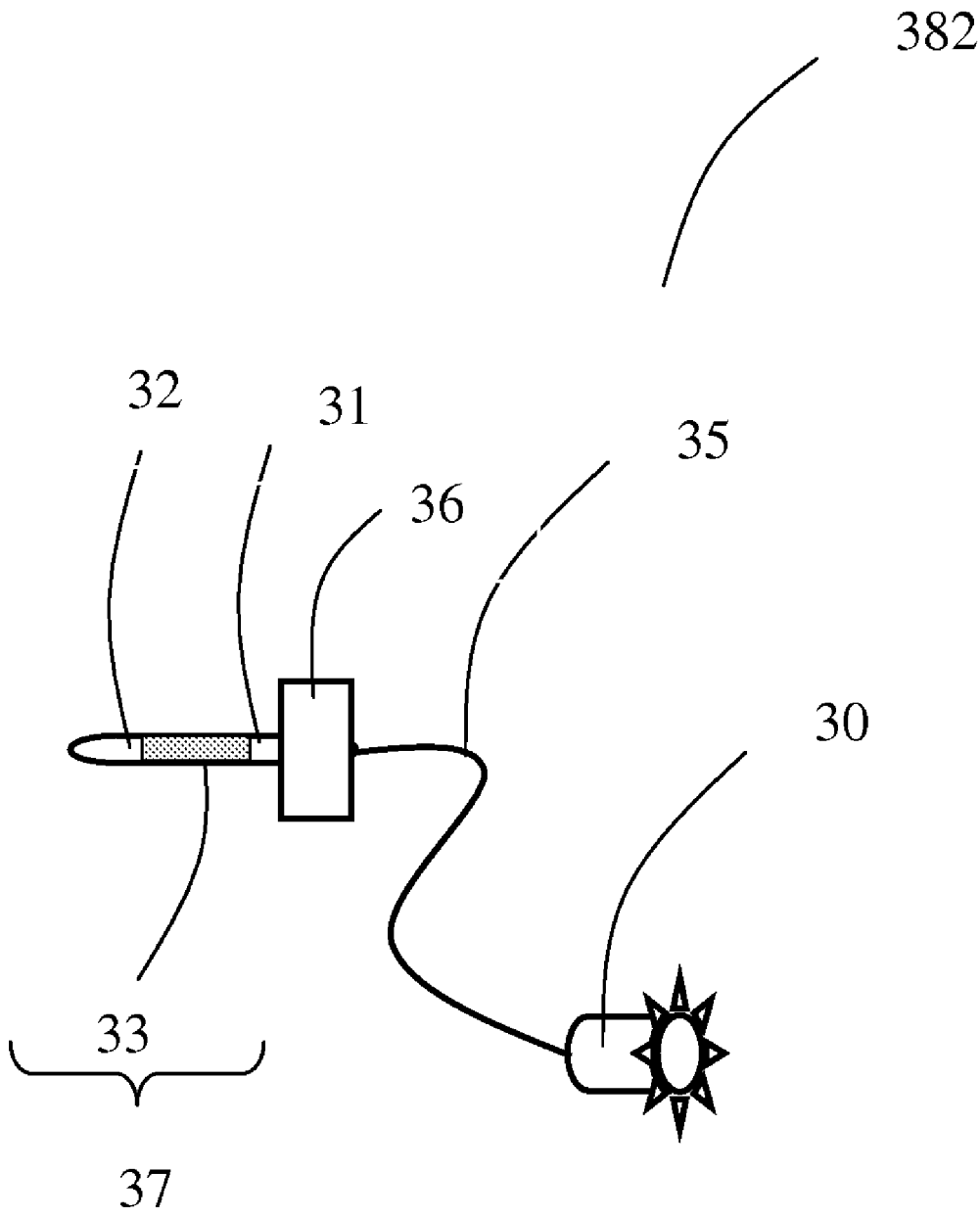
FIG. 5. shows a third embodiment of an ornamental article used in the present invention.

FIG. 5. shows a third embodiment of an ornamental article used in the present invention. In FIG. 5, a dangling ornamental article 382 is shown, a star head 30 is illustrated, and a short electric wire 35 connects between the star head 30 and a block 36 that is attached to the stem 37. A light emitting diode is enclosed in the star head 30, the electric wire 35 couples the two electrodes of the light emitting diode to the two electrodes 31, 32 of the coaxial stem 37. The dangling ornamental article 382 emits light when the stem 37 is inserted into the trunk or branches 20 of the decoration tree. The block 36 attached to the stem 37 facilitates handling of the stem by fingers for the insertion of the stem 37 into the sandwiched structure and for the withdrawal of the stem 37 from the sandwiched structure.

Figure 6:
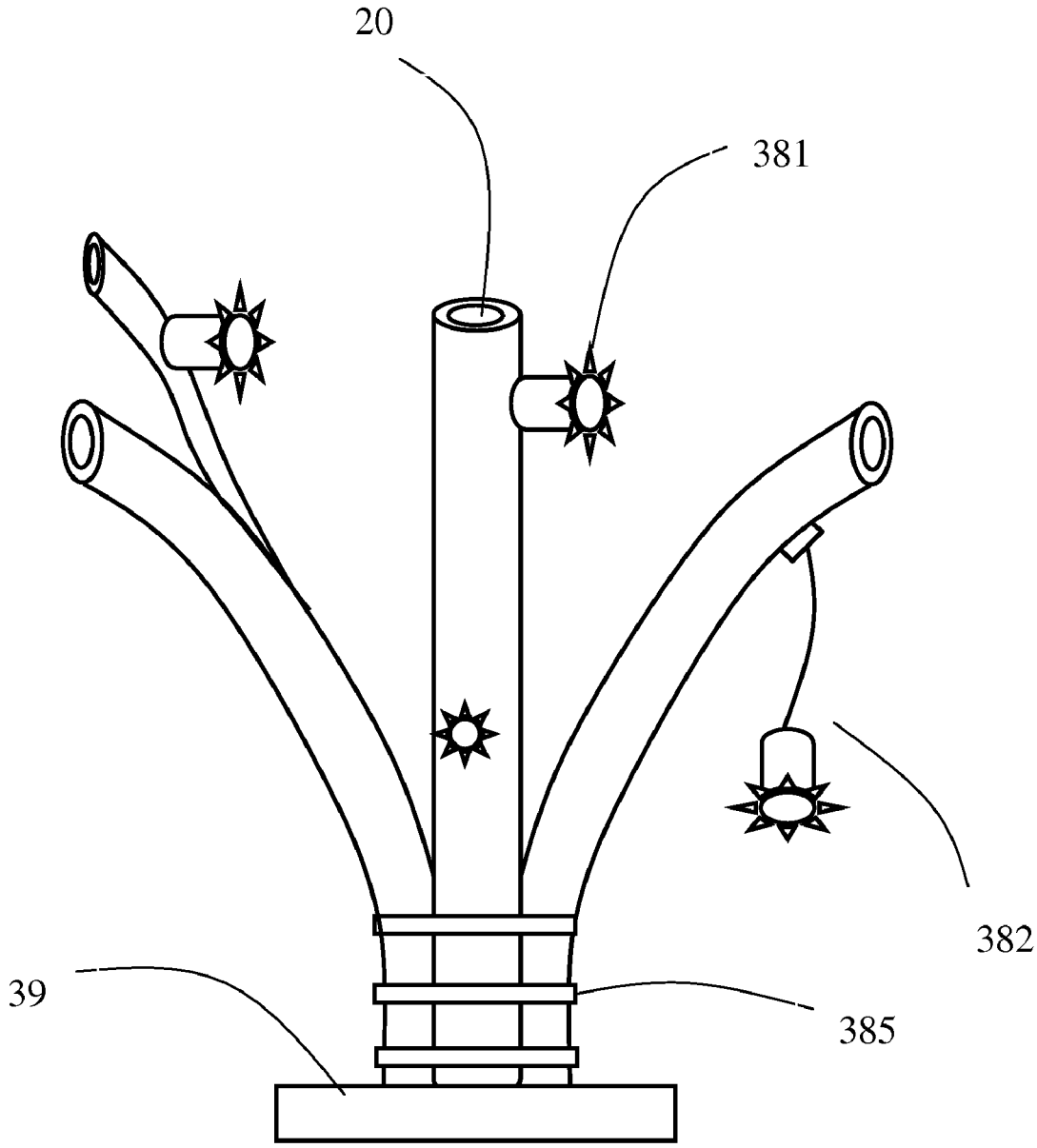
FIG. 6. shows a decoration tree according to the present invention.

FIG. 6. is a decoration tree according to the present invention. Three trunks 20 are exemplified. A first ornamental article 381 is inserted into the trunk 20. A dangling ornamental article 382 is inserted into a second trunk 20. The binding rope 385 ties the three trunks 20 as a bundle and then the trunk are fixed onto a pedestal 39.

While the preferred embodiments of the invention have been described, it will be apparent to those skilled in the art that various modifications may be made without departing from the spirit of the present invention. Such modifications are all within the scope of this invention as defined in the appended claims.

What is claimed is:

1. A decoration tree, comprising:

a sandwiched structure comprising a first metal mesh, an insulation layer, and a second metal mesh as a material of the trunk or branches of the decoration tree; wherein said insulation layer is between and insulates said first metal mesh and said second metal mesh.

2. A decoration tree as claimed in claim 1, further comprising:

at least an ornamental article, having a stem for insertion into said sandwiched structure; and a light emitting diode embedded in said ornamental article, and having two electrodes.

3. A decoration tree as claimed in claim 2, wherein said stem is a coaxial plug of a first electrode and second electrode, said first electrode and second electrode coupling to said two electrodes of said diode, respectively.

4. A decoration tree as claimed in claim 2, wherein said first metal mesh coupling to said first electrode, and said second metal mesh coupling to said second electrode when said ornamental article is inserted in said sandwiched structure.

5. A decoration tree as claimed in claim 2, further comprising: a bump on the stem between said first electrode and said second electrode for positioning and holding said stem in the inserted state.

6. A decoration tree as claimed in claim 1, wherein said insulation layer is made from a material selected from the group consisted of foam, sponge, plastic, rubber, and styrofoam.

* * * * *